US006986251B2

(12) United States Patent
Radcliff et al.

(10) Patent No.: US 6,986,251 B2
(45) Date of Patent: Jan. 17, 2006

(54) ORGANIC RANKINE CYCLE SYSTEM FOR USE WITH A RECIPROCATING ENGINE

(75) Inventors: Thomas D. Radcliff, Vernon, CT (US); Duane McCormick, Colchester, CT (US); Joost J. Brasz, Fayetteville, NY (US)

(73) Assignee: UTC Power, LLC, South Windsor, CT (US)

( * ) Notice: Subject to any disclaimer, the term of this patent is extended or adjusted under 35 U.S.C. 154(b) by 53 days.

(21) Appl. No.: 10/462,855

(22) Filed: Jun. 17, 2003

(65) Prior Publication Data

US 2004/0255587 A1 Dec. 23, 2004

(51) Int. Cl.

| | |
|---|---|
| ***F01K 25/00*** | (2006.01) |
| ***F01K 25/08*** | (2006.01) |
| ***F01K 7/32*** | (2006.01) |
| ***F01K 13/00*** | (2006.01) |
| ***F03G 7/00*** | (2006.01) |

(52) U.S. Cl. ..... 60/651; 60/646; 60/652; 60/655; 60/656; 60/658; 60/671

(58) Field of Classification Search ..... 60/651, 60/652, 646, 655, 656, 658, 671
See application file for complete search history.

(56) References Cited

U.S. PATENT DOCUMENTS 5,437,157 A * 8/1995 Bronicki ..... 60/655
5,860,279 A * 1/1999 Bronicki et al. ..... 60/655
6,598,397 B2 * 7/2003 Hanna et al. ..... 60/651
6,751,959 B1 * 6/2004 McClanahan et al. ..... 60/651
6,832,485 B2 * 12/2004 Sugarmen et al. ..... 60/780
2003/0213245 A1 * 11/2003 Yates et al. ..... 60/651

OTHER PUBLICATIONS

Thermodynamics of Waste Heat Recovery in Motor Ships, Professor A.J. Morton, MSc, Manchester University, Mechanical Engineering Dept., Trans I Mar E (C), 1981, vol. 93, Paper C69, pp. 1–7.

"Steam its generation and use", Babcock and Wilcox, 1992, Chapter 31, pp. 31–1 to 31–3.*

* cited by examiner

*Primary Examiner*—Sheldon J Richter
(74) *Attorney, Agent, or Firm*—Wall Marjama & Bilinski LLP

(57) ABSTRACT

In a waste heat recovery system wherein an organic rankine cycle system uses waste heat from the fluids of a reciprocating engine, provision is made to continue operation of the engine even during periods when the organic rankine cycle system is inoperative, by providing an auxiliary pump and a bypass for the refrigerant flow around the turbine. Provision is also made to divert the engine exhaust gases from the evaporator during such periods of operation. In one embodiment, the auxiliary pump is made to operate simultaneously with the primary pump during normal operations, thereby allowing the primary pump to operate at lower speeds with less likelihood of cavitation.

29 Claims, 2 Drawing Sheets

ORGANIC RANKINE CYCLE SYSTEM FOR USE WITH A RECIPROCATING ENGINE

FEDERALLY SPONSORED RESEARCH

The U.S. Government has a paid-up license in this invention and the right in limited circumstances to require the patent owner to license others on reasonable terms as provided for by the terms of DE-FC02-00CH11060 awarded by the Department of Energy.

BACKGROUND OF THE INVENTION

This invention relates generally to waste heat recovery systems and, more particularly, to a organic rankine cycle system for extracting heat from a reciprocating engine.

Power generation systems that provide low cost energy with minimum environmental impact, and which can be readily integrated into the existing power grids or which can be quickly established as stand alone units, can be very useful in solving critical power needs. Reciprocating engines arc the most common and most technically mature of these distributed energy resources in the 0.5 to 5 MWe range. These engines can generate electricity at low cost with efficiencies of 25% to 40% using commonly available fuels such as gasoline, natural gas or diesel fuel. However, atmospheric emissions such as nitrous oxides (NOx) and particulates can be an issue with reciprocating engines. One way to improve the efficiency of combustion engines without increasing the output of emissions is to apply a bottoming cycle (i.e. an organic rankine cycle or ORC). Bottoming cycles use waste heat from such an engine and convert that thermal energy into electricity.

Most bottoming cycles applied to reciprocating engines extract only the waste heat released through the reciprocating engine exhaust. However, commercial engines reject a large percentage of their waste heat through intake after coolers, coolant jacket radiators, and oil coolers. Accordingly, it is desirable to apply an organic rankine bottoming cycle which is configured to efficiently recover the waste heat from several sources in the reciprocating engine system.

One problem that the applicants have recognized in such a system is that, if the organic rankine cycle (ORC) is disabled by component failure or for planned maintenance, the ORC working fluid will no longer be circulated through the reciprocating engine and the temperature of the ORC working fluid inside the engine as well as the critical engine components being cooled by this fluid will quickly exceed the safe level point of about 200° F., and it becomes then necessary to shut down the engine and cease operation.

A general concern with bottoming cycles is that of cavitation in the pump that circulates the working fluid. Such a system requires a pump with a relatively small flow rate (e.g. 18 lbm/s) and a large pressure rise (e.g. 250 psi). Optimum pump performance dictates a certain relationship between pump head (pressure differential), pump flow rate, and pump speed. For maximum efficiency, a small, high speed, radial pump is desirable. However, such a pump is subject to cavitation especially since it is downstream of the condenser where the liquid from the condenser is only slightly subcooled. Cavitation occurs when the liquid entering the pump starts to locally vaporize due to the initial flow acceleration. That is, since the higher local velocity results in a lower local pressure, vapor bubbles will be created if the local pressure is below the saturation pressure.

One approach to solving the cavitation problem is to use a less efficient regenerative pump, but this results in 35–45% efficiency rather than the 60–80% efficiency that is obtainable with radial pumps, which are more prone to cavitation.

It is therefore an object of the present invention to provide an improved ORC waste heat recovery system.

Another object of the present invention is the provision in an ORC system used to extract heat from a reciprocating engine, to allow continued operation of the engine when the ORC system is inactive.

Another object of the present invention is the provision in an ORC system for preventing cavitation of the pump.

Yet another object of the present invention is the provision in an ORC for prevention of pump cavitation while at the same time maintaining pump efficiency.

These objects and other features and advantages become more readily apparent upon reference to the following description when taken in conjunction with the appended drawings.

SUMMARY OF THE INVENTION

Briefly, in accordance with one aspect of the invention, an auxiliary pump is provided in the refrigerant flow circuit of an ORC, with the pump being driven by a dedicated shaft or by electrical power from a generator. Thus, when the primary pump is inoperative, the dedicated auxiliary pump can be activated to circulate the cooling fluid through the reciprocating engine and allow its continued operation.

In accordance with another aspect of the invention, a bypass arrangement is provided to bypass the ORC turbo generator such that the flow of coolant passes directly from the evaporator/boiler to the condenser, and also to divert the reciprocating engine hot exhaust gases from the evaporator. This reduces the amount of heat that is transferred to the refrigerant and allows for a smaller pump to be used as the auxiliary pump.

By yet another aspect of the invention, provision is made for simultaneous operation of two pumps in series, a primary and an auxiliary pump during normal operation such that the speed of both pumps can be reduced to thereby reduce the risk of cavitation.

In the drawings as hereinafter described, a preferred embodiment is depicted; however, various other modifications and alternate constructions can be made thereto without departing from the true spirit and scope of the invention.

DETAILED DESCRIPTION OF THE INVENTION

Figure 1:
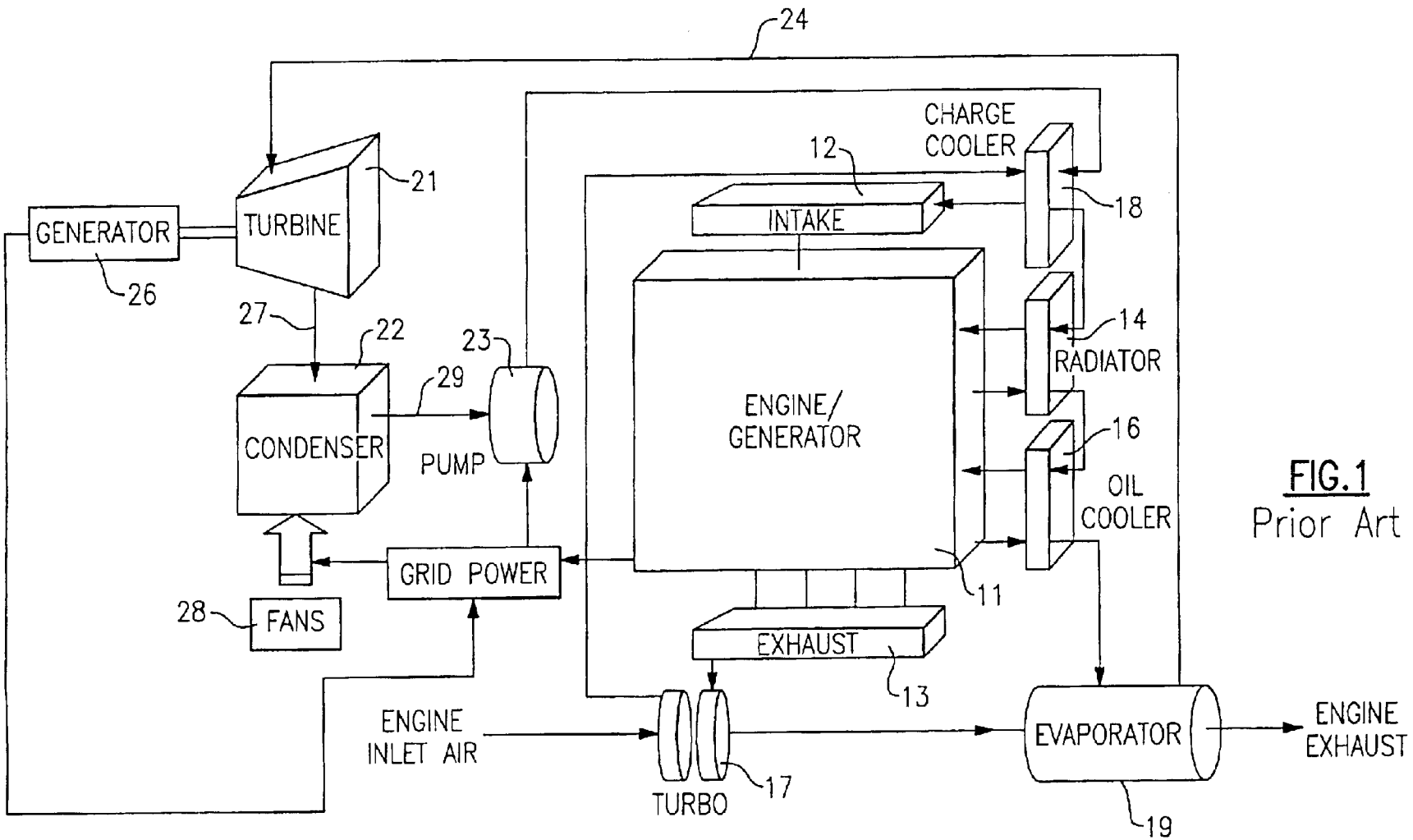
FIG.1 Prior Art
FIG. 1 is a schematic illustration of an organic rankine cycle system as incorporated with a reciprocating engine.

Referring now to FIG. 1, there is shown a reciprocating engine 11 of the type which is typically used to drive a generator (not shown) for purposes of providing electrical power for consumer use. The engine 11 has an air intake section 12 for taking in air for combustion purposes and an exhaust 13 which may be discharged to the environment, but is preferably applied to convert a portion of the energy therein to useful purposes.

The engine 11 also has a plurality of heat exchangers with appropriate fluid for maintaining the engine 11 at acceptable operating temperatures. A radiator 14 is provided to take heat away from a liquid coolant that is circulated in heat exchange relationship with the portion of the engine where combustion occurs, while an oil cooler 16 is provided to remove heat from a lubricant that is circulated within the moving parts of the engine 11.

The engine 11 may be provided with a turbo charger 17 which receives high temperature, high pressure exhaust gases from the exhaust section 13 to compress the engine inlet air entering the turbo charger 17. The resulting compressed air, which is heated in the process, then passes to a charge cooler 18 and is cooled in a manner to be described hereinafter, prior to passing into the intake 12 of the engine to be mixed with fuel for combustion. The exhaust gases, after passing through the turbo charger 17, pass through an evaporator 19, which is a part of an organic rankine cycle (ORC) system that is shown on the left side of FIG. 1 and which is adapted to use the exhaust waste heat from the engine 11 while at the same time cooling the various components thereof and maintaining it at an acceptable operating temperature.

In addition to the evaporator 19, the ORC includes a turbine 21, a condenser 22 and a pump 23. The turbine 21 receives hot refrigerant gas along line 24 from the evaporator 19 and responsively drives a generator 26. The resulting low energy vapor then passes along line 27 to the condenser 22 to be condensed to a liquid form by the cooling effect of fans 28 passing ambient air thereover. The resulting liquid refrigerant then passes along line 29 to the pump 23 which causes the liquid refrigerant to circulate through the engine 11 to thereby generate high pressure vapor for driving the turbine 21, while at the same time cooling the engine 11. Both the fans 28 and the pump 23 are driven by electrical power from the grid 31.

As will be seen in FIG. 1, relatively cool liquid refrigerant from the pump 23 passes sequentially through ever increasing temperature components of the engine 11 for providing a cooling function thereto. That is, it passes first through the charge cooler 18, where the temperature of the liquid refrigerant is raised from about 100° to 130°, after which it passes to the radiator 14, where the refrigerant temperature is raised from 130° to 150°, after which is passes to an oil cooler 16 where the refrigerant temperature is raised from 150° to 170°. Finally, it passes through the evaporator 19 where the liquid is further preheated before being evaporated and superheated prior to passing on to the turbine 21.

In this system as described, it will be recognized that if the ORC system is not operating properly, such as, for example, if the pump 23 fails, the cooling effect of the refrigerant passing through the various heat exchangers will be lost and, if the engine 11 would continue to operate, it will heat up to unacceptable temperatures, requiring its shut down.

Also peculiar to the system as shown in FIG. 1, the pump 23 may be a small high speed radial pump that typically is high in efficiency but subject to the occurrence of cavitation. Alternatively, a regenerative pump which is generally not subject to cavitation but operates at much lower efficiencies, may be used.

Figure 2:
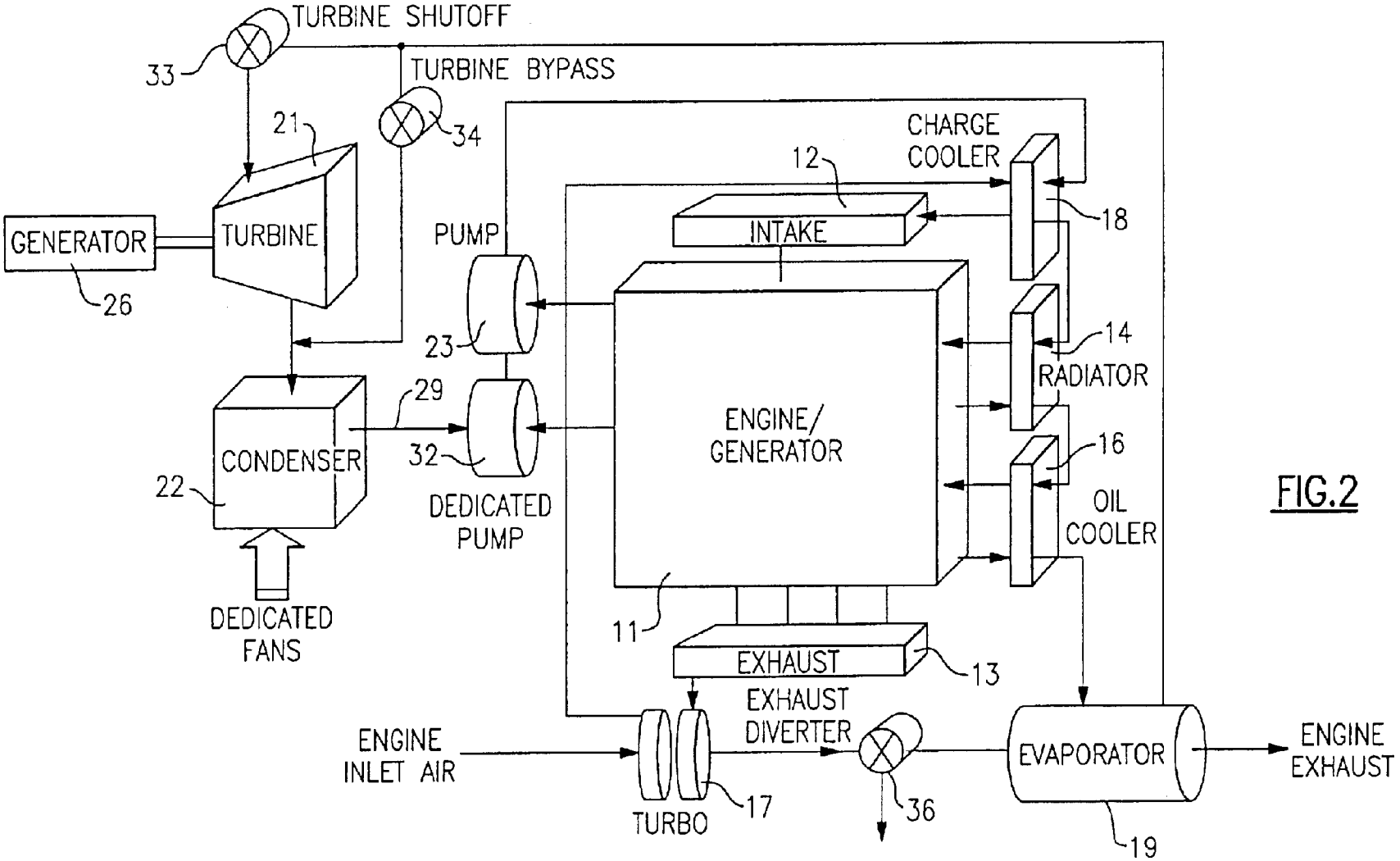
FIG. 2 is a schematic illustration of an organic rankine cycle system as modified in accordance with the present invention.
Figure 1:
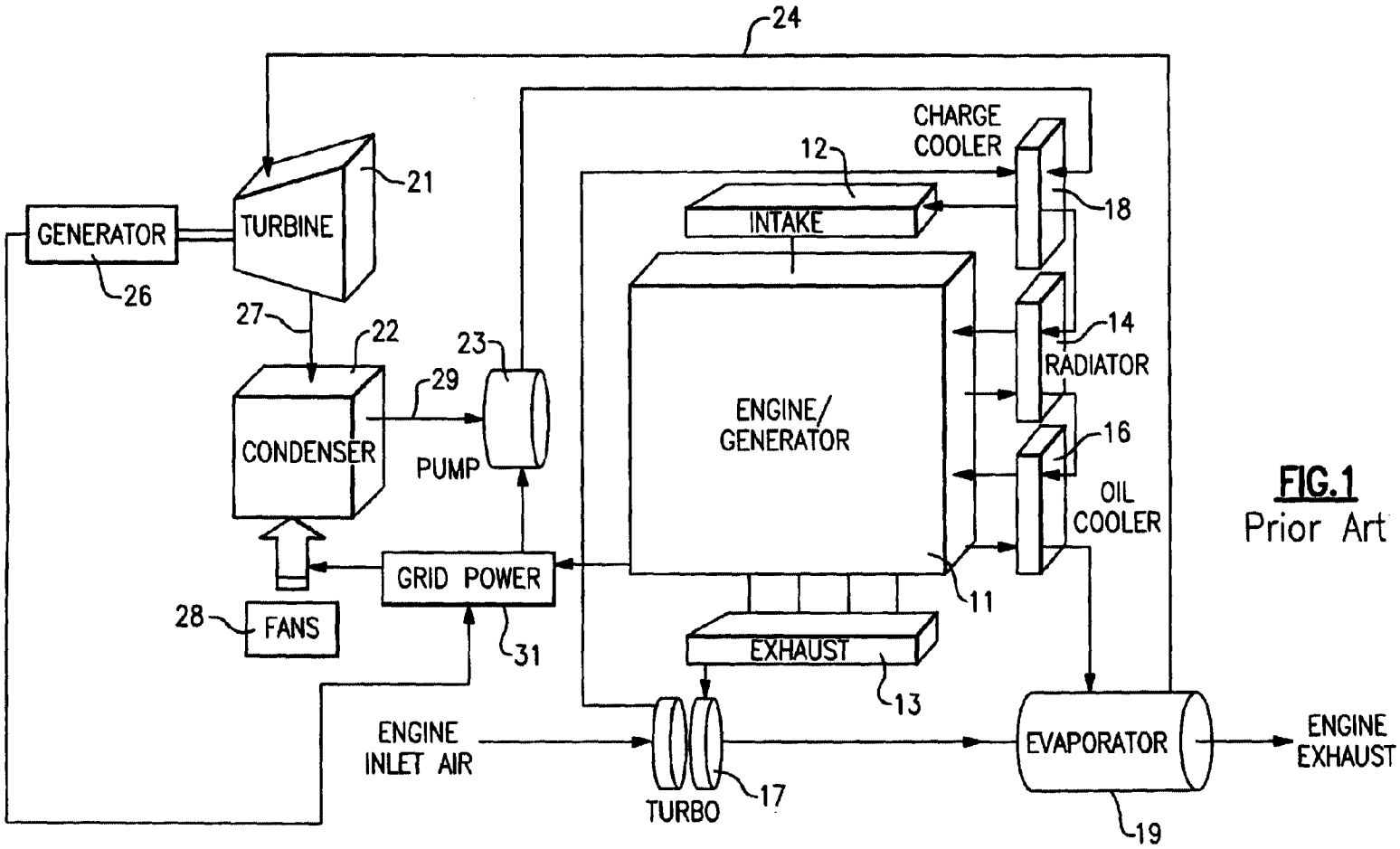
FIG.1 Prior Art

Referring now to FIG. 2, there is shown the same system with certain additions being made for purposes of providing a means of cooling the engine 11 during periods in which the ORC is not operating.

Here a dedicated auxiliary pump 32 is provided in the line 29 for either boosting the pumping capacity when the pump 23 is on line or for replacing the pumping capacity of the pump 23 when the pump 23 is not on line. The various possible combinations will be described hereinafter.

Also provided are a number of valves that may be selectively operated to facilitate the continued operation of the engine 11 during periods in which the ORC system is inoperative. A pair of passively sprung vapor valves 33 and 34 are provided to bypass the turbo generator 21 during such periods. That is, to continue operation of the engine 11 when the ORC is inoperative, the valve 33 is closed and the valve 34 is opened such that the hot refrigerant gas from the evaporator 19 passes directly to the condenser 22, with the resulting liquid refrigerant then being circulated by the auxiliary pump 32 through the various heat exchangers 18, 14, 16 and 19 to complete the circuit.

Recognizing that when the turbine 21 is not operating, the energy that is normally removed from the system by operation of the turbine 21 will be excessive, and the engine 11 will not be properly cooled if further changes are not made. Accordingly, provision is made to further remove heat from the system such that the auxiliary path as just described will be capable of maintaining acceptable temperature levels in the engine 1 when it continues to operate.

Recognizing that the majority of the heat passing to the ORC system in the conventional manner as described in respect to FIG. 1, comes from the engine exhaust 13, exhaust diverter valve 36 is provided to selectively divert the exhaust gases from the evaporator 19 and pass them directly to the atmosphere as shown. This reduces the energy that is added to the refrigerant to that from the charge cooler 18, the radiator 14, and the oil cooler 16 such that the energy can be dissipated by the condenser 22 without operation of the turbine 21. The pump 32 is properly sized such that the temperature of the refrigerant leaving the evaporator 19 is in the range of 170° F.

Considering now the possible operating modes of the two pumps 23 and 32, one possibility is that of operating only the main pump 23 during normal operation and only the auxiliary pump 32 during periods in which the ORC is not operating. In such case, the main pump 23 must necessarily be of a relatively large head since it must bear the entire load. With the potential problem of cavitation in mind, a suggested pump for this use is a regenerative pump (such as the Roth 5258 pump). A suggested pump that could be used as the auxiliary pump 32 is the Sundyne P2000 pump.

In operation, the above described pump combination will be controlled as follows. During normal operation, when the valve 33 is open, the valve 34 is closed, and the valve 36 is set to allow exhaust gases to flow to the evaporator 19, the main pump 23 is operating at all times and the auxiliary pump 32 is turned off at all times. During periods in which the ORC is inoperative, the valve 33 is closed, the valve 34 is opened, and the valve 36 is placed in a position so as to divert the exhaust flow from the evaporator 19. In such case, the main pump 23 is turned off at all times and the auxiliary pump 32 is turned on at all times.

Considering now that the auxiliary pump 32 can be used during normal operation in order to deliver part of the head of the main pump 23, it has been recognized that, for the main pump 23, a lower speed pump, and thus one less likely to have cavitation problems, can be used. For example, rather than one having a head of 300 psi and a pump speed of 7000 rpm as described hereinabove, the pump head can be reduced to 150 psi with a pump speed of 5000 rpm. A suggested pump for this purpose would be the Sundyne P2000.

With such a pump combination as described hereinabove, during normal operation both pumps will be on at all times, and during periods of which the ORC is not operative, only the auxiliary pump will be on.

In the embodiment as described with respect to FIG. 2, the auxiliary pump 32 is placed upstream of the main pump 23, but this order could just as well be reversed. Further, it is possible to have the two pumps in parallel relationship rather than in series, but this would not offer the advantages of head reduction, cavitation prevention and effective engine cooling during ORC shutdown and would appear to introduce certain disadvantages.

While the invention has been shown and described with respect to a preferred embodiment thereof, it should be understood by those skilled in the art that the foregoing and various other changes, omissions and additions in the form of a detail thereof made be made without departing from the true sprit and scope of the invention as set forth in the following claims.

We claim:

1. An energy recovery system of the type wherein heat is extracted from an engine by refrigerant passing through a heat exchanger of an organic rankine cycle system, comprising:

at least one heat exchanger for transferring heat from said engine to a fluid passing through said heat exchanger;

a turbine for receiving said heated fluid from said at least one heat exchanger and for transferring its thermal energy to motive power, with said fluid being cooled in the process;

a condenser for receiving said cooled fluid and for further cooling said fluid to cause it to change to a liquid state;

a first pump for receiving said liquid refrigerant and passing it to said heat exchanger; and a second pump being disposed in a fluid flow path between said condenser and said heat exchanger and being capable of receiving said liquid refrigerant and passing it to said at least one heat exchanger and including control means for operating said first pump during normal operation in which said engine and said organic rankine cycel system are operating, and for operating only said second pump during periods in which said engine is operating and said organic rankine cycle system is not operating.

2. A system as set forth in claim 1 wherein said at least one heat exchanger is so disposed as to have intake air to the engine passing therethrough.

3. A system as set forth in claim 1 wherein said at least one heat exchanger is so disposed as to have engine coolant passing therethrough.

4. A system as set forth in claim 1 wherein said at least one heat exchanger is so disposed as to have engine lubricant passing therethrough.

5. A system as set forth in claim 1 wherein said at least one heat exchanger is so disposed as to have said engine exhaust gases passing therethrough.

6. A system as set forth in claim 1 wherein said at least one heat exchanger comprises a plurality of heat exchangers which derive heat from a plurality of sources within said engine.

7. A system as set forth in claim 1 wherein said first and second pump are arranged in series relationship.

8. A system as set forth in claim 1 and including a turbine bypass arrangement for selectively bypassing the turbine and sending said heated fluid directly from said at least one heat exchanger to said condenser.

9. A system as set forth in claim 8 wherein said bypass arrangement also includes means for diverting the flow of engine exhaust gases from said at least one heat exchanger.

10. A system as set forth in claim 1 wherein the head capability of said first pump is relatively large as compared with that of said second pump.

11. A system as set forth in claim 10 wherein said during normal operation with both said engine and said turbine operating, only said first pump is in operation.

12. A system as set forth in claim 1 wherein the head capability of said first of pump is comparable to that of said second pump.

13. A system as set forth in claim 12 wherein during normal operation with both said engine and said turbine operating, both said first and second pumps are in operation.

14. A system as set forth in claim 12 wherein during periods of operation wherein said engine is operating but said turbine is not operating, only said first pump is in operation.

15. A method of operating a waste heat recovery system having an organic rankine cycle with its motive fluid in heat exchange relationship with relatively hot fluids of an engine, comprising the steps of:

providing a first pump for circulating motive fluids from a condenser of said organic rankine cycle system to at least one heat exchanger of said engine and then serially to a turbine of said organic rankine cycle and back to said condenser;

providing a second pump between said organic rankine cycle condenser and said at least one heat exchanger, said second pump being capable of circulating motive fluids from said organic rankine cycle condenser to said at least one heat exchanger; and control means for operating said first pump during normal operation in which said engine and said organic rankine cycle system are operating, and for operating said second pump during periods in which said engine is operating and said organic rankine cycle system is not operating.

16. A method as set forth in claim 15 wherein said at least one heat exchanger is made to have an engine air intake flow passing therethrough.

17. A method as set forth in claim 15 wherein said at least one heat exchanger is made to have fluid from an engine radiator passing therethrough.

18. A method as set forth in claim 15 wherein said at least one heat exchanger is made to have engine lubricant passing therethrough.

19. A method as set forth in claim 15 wherein said at least one heat exchanger is made to have engine exhaust gases passing therethrough.

20. A method as set forth in claim 15 wherein said at least one heat exchanger comprises a plurality of heat exchangers with a plurality of engine fluids passing therethrough.

21. A method as set forth in claim 15 wherein said first and second pumps are arranged in serial flow relationship.

22. A method as set forth in claim 15 and including the further step of providing a bypass around said turbine during periods in which said turbine is not operating.

23. A method as set forth in claim 22 including the further step of diverting the flow of exhaust gases from said at least one heat exchanger during periods of which said turbine is not operating.

24. A method as set forth in claim 15 wherein said first pump is one of substantially greater head capability then said second pump.

25. A method as set forth in claim 24 and including the steps of controlling said first and second pumps such that during normal operation, with both said engine and said turbine operating, only said first pump is made to operate.

26. A method as set forth in claim 25 and including the steps of controlling said first and second pumps such that during periods in which said engine is operating but said turbine is not operating, only said second pump is made to operate.

27. A method as set forth in claim 15 wherein the operating head capability of said first pump is comparable to that of said second pump.

28. A method as set forth in claim 27 and including the step of simultaneously operating said first and second pumps during operation.

29. A method as set forth in claim 27 and including the steps of operating only said second pump during periods in which said turbine is not in operation.

* * * * *

UNITED STATES PATENT AND TRADEMARK OFFICE

CERTIFICATE OF CORRECTION

PATENT NO. : 6,986,251 B2
APPLICATION NO. : 10/462855
DATED : January 17, 2006
INVENTOR(S) : Thomas D. Radcliff et al.

It is certified that error appears in the above-identified patent and that said Letters Patent is hereby corrected as shown below:

FIG. 1 add numeral --31--as shown on attached page.

Column 3, line 41 change "after which is passes" to --after which it passes--

Column 5 line 36 change "cycel" to --cycle--

Signed and Sealed this

Third Day of October, 2006

JON W. DUDAS
*Director of the United States Patent and Trademark Office*